United States Patent [19]

Kaufman

[11] Patent Number: 5,033,653

[45] Date of Patent: Jul. 23, 1991

[54] DISPENSER WITH COMPRESSION CHAMBER

[76] Inventor: John G. Kaufman, 858 Condor Drive, Burlington, Ontario, Canada, L7T 3A7

[21] Appl. No.: 369,417

[22] Filed: Jun. 21, 1989

[30] Foreign Application Priority Data

Jun. 21, 1988 [CA] Canada ..... 570041

[51] Int. Cl.[5] ..... B65D 25/42

[52] U.S. Cl. ..... 222/185; 222/207; 222/478

[58] Field of Search ..... 222/185, 207, 212, 457, 222/478, 479, 481, 442, 464

[56] References Cited

U.S. PATENT DOCUMENTS

| | | | |
|---|---|---|---|
| 1,319,376 | 10/1919 | Cooper | 222/457 |
| 1,840,283 | 1/1932 | Anderson | 222/481 |
| 2,637,470 | 5/1953 | Wolcott | 222/481 |
| 3,157,319 | 11/1964 | Schwienbacher | 222/207 |
| 3,178,072 | 4/1965 | Pickels | 222/207 |
| 4,240,570 | 12/1980 | Brown et al. | 222/442 |
| 4,324,349 | 4/1982 | Kaufman | 222/207 |
| 4,516,697 | 4/1985 | Dreps et al. | 222/212 |
| 4,635,828 | 1/1987 | Kaufman | 222/185 |
| 4,645,097 | 2/1987 | Kaufman | 222/207 |

*Primary Examiner*—Michael S. Huppert
*Attorney, Agent, or Firm*—Rogers & Scott

[57] ABSTRACT

A dispenser is provided for liquids, the dispenser having a container and an outlet at a predetermined first level. The pressure in the container can be varied and a reservoir receives liquid from the outlet. A discharge passageway extends upwardly from the first level and terminates at a discharge opening at a second level, and an air relief opening is provided above the first level. The relief opening is no lower than the second level so that liquid displaced from the container flows into the reservoir and out of the passageway while air is trapped in the reservoir above the first level. consequently any gradual increase in temperature will cause air from the reservoir to be displaced through the air relief opening to minimize the risk of temperature driven dispensing.

38 Claims, 4 Drawing Sheets

FIG.1
PRIOR ART
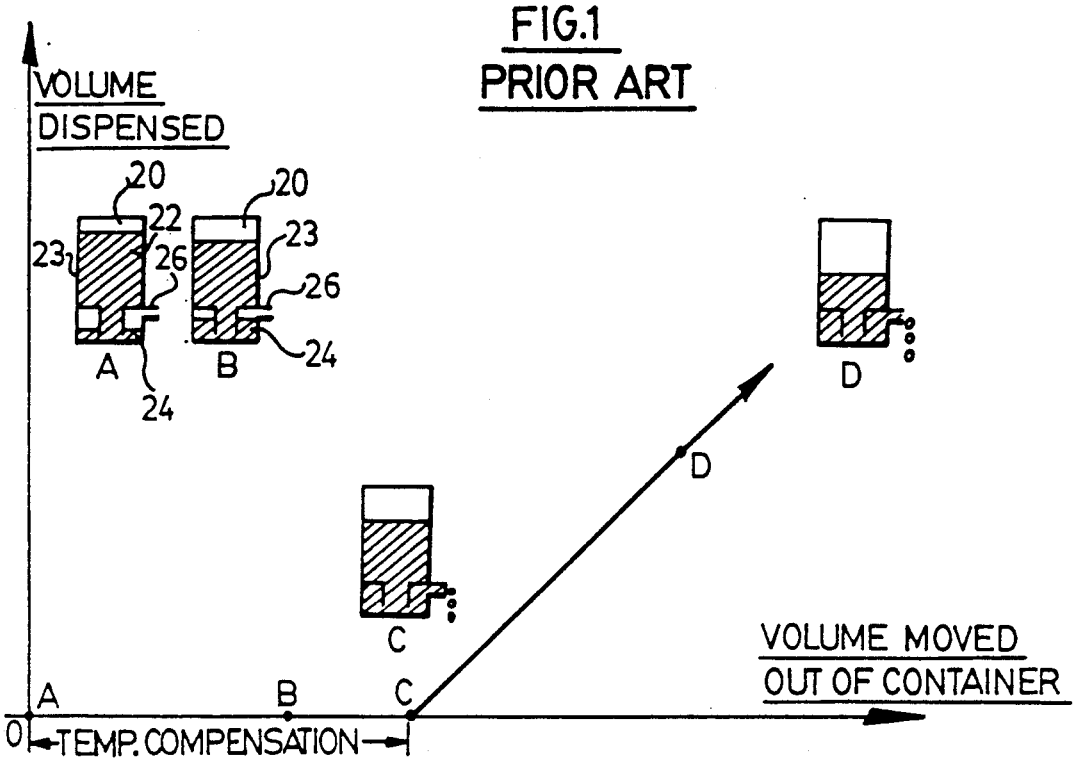
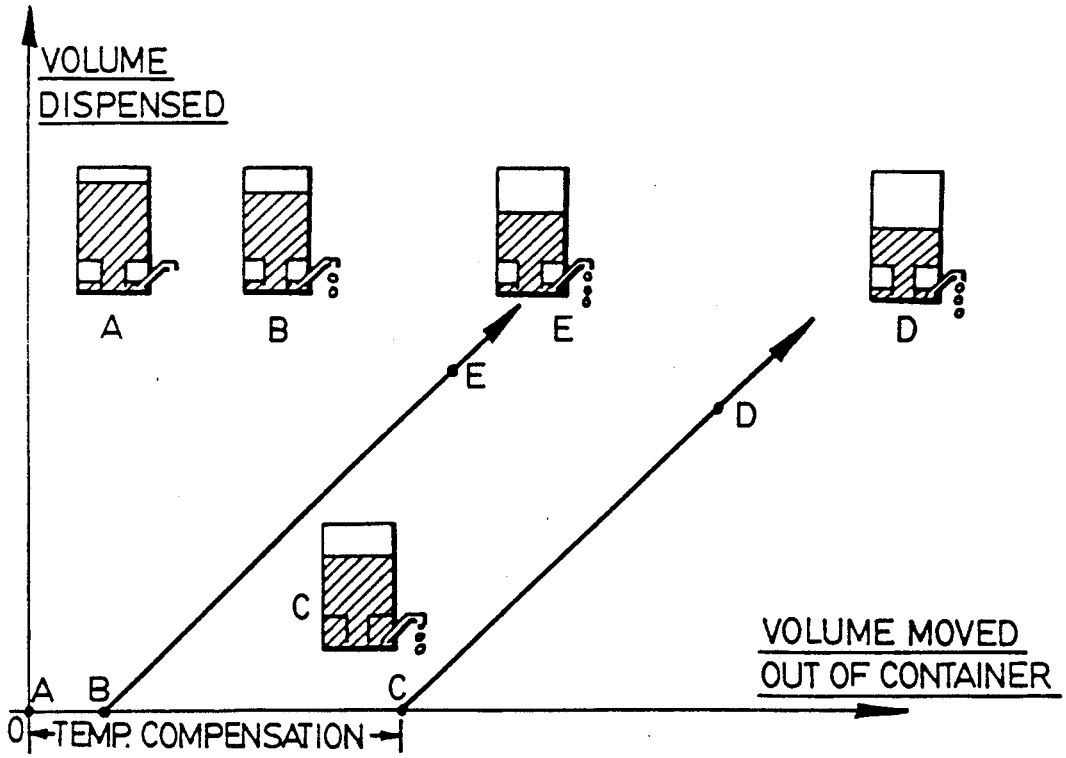
FIG.2

DISPENSER WITH COMPRESSION CHAMBER

This invention relates to dispensers for liquids and more particularly to dispensers used domestically to store and dispense such varied products as vinegar, hair shampoo, ketchup, etc.

The invention will be described primarily with reference to consumer products used domestically, but does have application to dispensing liquids from larger containers used in commercial establishments.

Smaller quantities of products in liquid form have for many years been packaged in a variety of containers suitable for shipping, displaying, handling and eventual point-of-purchase sale. Historically, the most common container has been the glass bottle which can be made in a variety of shapes and sizes and with different types of closures. More recently, however, glass containers have been displaced to some extent by containers of synthetic plastic materials which can be moulded, blow-moulded and generally formed into a great variety of shapes and sizes. Also, because of the nature of plastics materials, closures for these containers can be of many varied types ranging from simple screw-caps similar to those used with glass bottles, to flip tops and valved openings.

A further development has been the introduction of dispensers into the marketplace resulting in a growing impetus to use these dispensers wherever possible. The major characteristic of a dispenser when compared with a simple container is that a dispenser can be activated in some way to provide some of its contents without the need to remove caps or closures, and in some cases without even lifting up the dispenser. This invention provides an improved dispenser which can take a variety of forms.

There have been a number of approaches to the design of dispensers for domestic liquid products, and they fall into three main groups. Firstly, there is the simple device which allows the dispenser to be lifted and tilted to allow some of the contents to fall under the influence of gravity from the dispenser before the dispenser is again held upright to stop the flow. Dispensers of this type are used as attachments to bottles of liquor to permit a particular volume of liquor to be dispensed with each tilt of the bottle.

A second approach is to provide some mechanical device which, when activated, forces some of the liquid out of the dispenser. An example of this would be trigger dispensers which incorporate a pump actuated by the trigger to force some of the contents out of the dispenser. This requires some manual dexterity as well as the application of some force to do work on the dispenser.

The third type of dispenser involves the use of stored energy. An example of this would be an aerosol which contains a gas under pressure, or in some instances, a stretched bladder containing the contents so that the operation of a valve will allow the energy from the bladder to displace some of the liquid contents out of the dispenser.

Of these three types, the present invention falls into the category of a dispenser which requires the application of a force to displace some of the liquid.

The design of all dispensers must meet numerous criteria which are to some extent conflicting. From the standpoint of appearance on a shelf for sale, it is generally accepted that the overall impression given by the dispenser will affect the sales. If the dispenser matches the image projected by the product, then this seems to have an effect on purchases and on the success of the product. On the other hand, the dispenser is a throw-away item so that the cost of the dispenser must be kept to a minimum in order to be competitive in the marketplace.

This cost consideration is of course dependent on complexity so that the less complex the dispenser the more acceptable it would be in terms of the cost of production. It is therefore a challenge to design a dispenser which is both appealing to the eye when containing a particular product and also inexpensive to manufacture while of course operating adequately once the purchaser has started to use the product.

Once the product is purchased and taken to the consumer's home, there are important considerations for the consumer. Firstly the product must function or be useful in the manner anticipated by the purchaser. However, the dispenser containing the product also comes into play because if it is difficult to use, or unreliable in any way, then it may affect the purchaser's decision whether or not to buy the same product again. Reliability includes a number of possible difficulties, but high on the list would be a dispenser which does not dispense cleanly and which possibly drips or allows liquid to soil the outside of the container between uses. This has led to the development of a large number of valved dispensers having designs of valves which are intended to cut off the flow clearly and without dripping and soiling. While there is no doubt that suitable structures have been developed, they do add significantly to the cost of the dispenser. As a result attempts have been made to simplify dispensers by eliminating the valving. Such attempts have resulted in difficulty because once the valve is removed temperature fluctuations can drive the contents out of the dispenser with a resulting tendency for dripping. Also, the actual dispensing is less than adequate in many instances.

Synthetic plastics materials also lend themselves to the manufacture of dispensers which have flexible bodies to allow deformation to apply pressure to the contents. This form of dispenser, while avoiding the use of a trigger, nevertheless continues to need the valve which commonly involves some form of closure which is opened before dispensing and closed after dispensing.

The present inventor taught the use of dispensers which have no moving parts and which satisfy the requirements of clean dispensing with temperature compensation to permit the dispenser to be placed in various locations within a designed temperature range without inadvertent dripping or dispensing caused by these temperature variations. Such structures are taught in U.S. Pat. No. 4,324,349, 4,635,828 and 4,645,097. The structures are simple, relatively inexpensive and are actuated by squeezing the container or applying a pressure to the contents in some other way. The dispensers include a reservoir containing some of the liquid to be dispensed and in communication with the main part of the dispenser in the form of a container where the major volume of the liquid is contained. Air is trapped above the liquid in the container under a negative pressure which prevents the liquid flowing through the reservoir and out through a discharge passageway. When pressure is applied to the contents, the negative pressure is overcome so that liquid will flow through the reservoir and out via the passageway. As soon as the pressure is released, a negative pressure is created by the walls returning from a deflected condition to the original condition so that air is sucked back into the passageway and reservoir to set up a condition of equilibrium. As the air is sucked back, liquid is cleaned out from the passageway and some of the air finds its way through the liquid to finish above the liquid in the container and some remains in the reservoir. It is the air in the reservoir which effectively provides the temperature compensation. As temperature increases, the negative pressure above the liquid in the container becomes more positive resulting in some flow into the reservoir, and liquid will consequently rise in the reservoir and displace air out of the passageway. This action can continue within a range of calculated temperature compensation.

Clearly the volume of the reservoir in relation to the volume of the container is an essential design criterion for structures of this kind, and if large temperature compensation is required, then there must be a large reservoir which will have to be filled during dispensing before any of the liquid will leave the discharge passageway.

While such a structure will have adequate temperature compensation, there will be no quick discharge in response to actuation. Conversely, if the overriding design criterion is that the response be quick, (i.e. there will be discharge very shortly after the user starts to actuate the container) then a minimum of volume must be provided for the air in the reservoir and the range of temperature compensation is reduced accordingly. These two conflicting design criteria result in designs according to these patents having to be created for specific products depending, among other things, on the temperature range anticipated, the viscosity of the product, and the response rate required.

A further consideration is the relationship between the discharge passageway and the viscosity of the liquid in the dispenser. A larger discharge passageway will allow returning air to tunnel through the liquid in the passageway as the air is sucked into the dispenser. This can result in liquid remaining on the walls of the passageway and subsequently dripping from the dispenser. As a result, the size of the passageway must be controlled in relation to viscosity so that air sucked back into the dispenser will have a better chance to clear the passageway.

It will be evident from the foregoing discussion that structures according to the above patents can have dripping problems if they are not designed for specific criteria, including temperature range, response rate, viscosity etc. A first form of drip results if the temperature rises above the designed limit. Liquid will then be forced through the discharge passageway to drip from the dispenser. A second form of drip will result if the suck-back is not designed correctly. Liquid can remain in the passageway after suck-back and it may then drip under the influence of gravity. Clearly, these two forms of dripping must be considered individually and independently.

Accordingly the invention provides a dispenser for liquids having a container for holding liquid at levels above a predetermined level, and including means to vary the pressure in the container. An outlet is provided at a level below the predetermined level and a reservoir is in fluid communication with the container. The reservoir defines an air relief opening to permit pressure changes caused by temperature fluctuations to be equalized with atmospheric pressures and a discharge passageway is provided in fluid communication with the container to lead liquid from the container to the outlet when said means is used to increase the pressure in the container.

The invention will be better understood with reference to the drawings and associated description wherein:

FIG. 1 is a graphical representation of prior art structures of the type taught by the present inventor in the aforementioned U.S. patents;

FIG. 2 is a graphical representation similar to FIG. 1 and illustrating the present invention;

Figure 3:
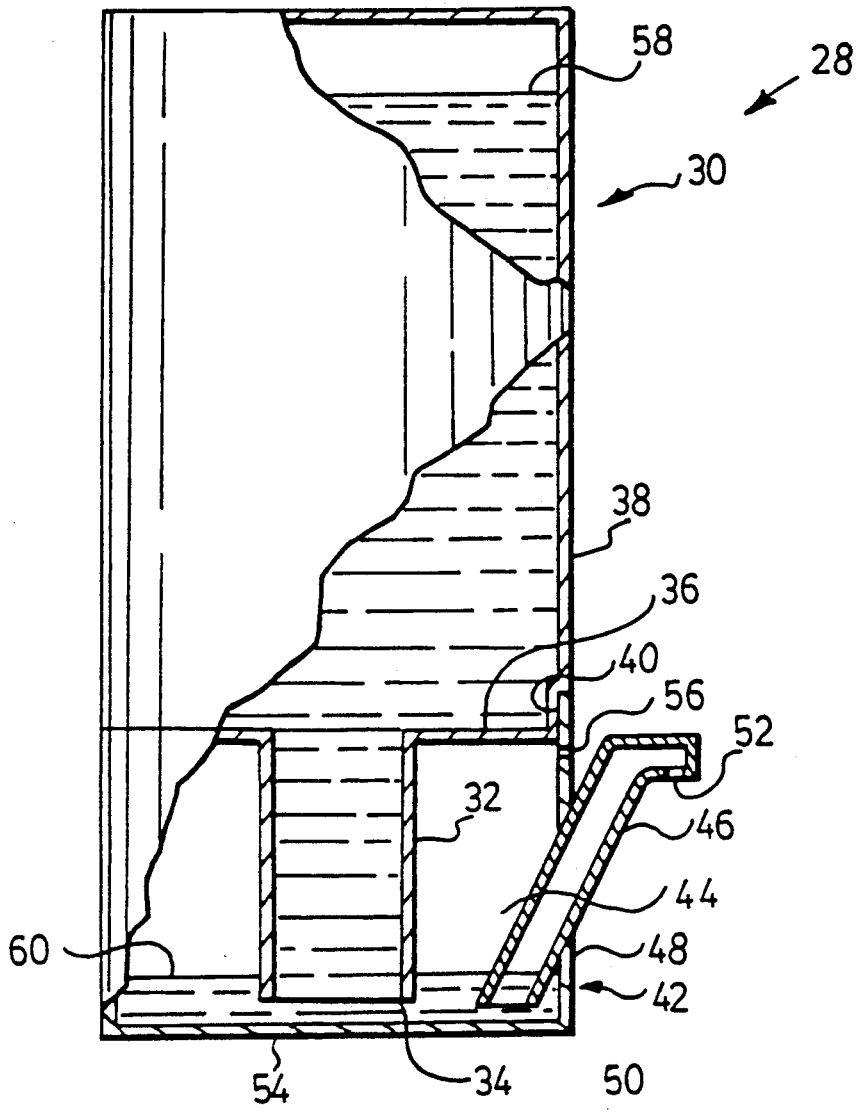
FIG. 3 is a partly sectioned side view of an exemplary structure to describe the principle of the invention in association with FIG. 2.

Reference is made firstly to FIG. 1 which illustrates graphically a typical prior art structure of the type described in the present applicant's aforementioned U.S. patents. In association with the graph, the structure is shown in section at different conditions of dispensing and these are labelled A, B, C, and D. In the condition A, the dispenser is at rest with a negative pressure in a space 20 above liquid 22. The portion of the dispenser containing the body of liquid is referred to as a container 23 and below it is a reservoir 24 having air above liquid at atmospheric pressure. There is an outlet 26 through which liquid will be dispensed. In the condition A, the negative pressure at the top of the container prevents flow through the reservoir unless there are changes caused by temperature fluctuations or manual deformation of the container 23.

In the condition shown at B, and its corresponding position indicated on the graph, the temperature has increased resulting in change in pressure at 20 and a lowering of the level of liquid in the container 23. The result is that the level of liquid rises in the reservoir 24 approaching the outlet 26. This will continue till point C is reached and it will be seen from view C, that dripping commences at this point. Should the temperature continue to increase, then there will be a displacement of volume from the dispenser equal to the volume moved out of the container 23. This will continue as the temperature rises until a point D is reached which corresponds to the drawing D.

Consider now a situation at constant temperature. A person deflecting the container 23 will cause flow through the reservoir in the same fashion as that described with reference to the temperature compensation In other words there will be a transition through the drawings A, B, C to D. This means that the response time, i.e. the time between starting to deform the container and the time when liquid issues from the outlet, will be quite large. Put another way, if there is a large temperature compensation then the response time will be directly related to that because the two parameters are inseparable due to the need to cause liquid to rise in the reservoir until it meets the outlet 26.

While containers of the type illustrated with reference to FIG. 1 are advantageous in most situations, they must be designed to provide an adequate range of temperature compensation while designing for reasonable or even rapid response times. These two criteria are conflicting as previously discussed.

The present invention is intended to separate the two design criteria so that temperature compensation can be provided over a wide range while having minimal effect on response time. Similarly, should the response time for any reason be required to be slow, then this can be accommodated within the design parameters of the temperature compensation.

Reference is next made to FIGS. 2 and 3. FIG. 2 corresponds for purposes of comparison with FIG. 1, and FIG. 3 illustrates an exemplary structure providing the characteristics shown in FIG. 2. A dispenser designated generally by the numeral 28 is made up of an inverted flexible bottle-shaped container 30 having a neck 32 and outlet 34 at its bottom end. The neck 32 meets the container at a transverse wall 36 which terminates adjacent a side wall 38 at an annular recess 40. An upper end of a cap 42 sits in the recess attached by any convenient means and combines with the wall 36 to define a reservoir 44. An outlet passageway 46 eXtends through a side wall 48 of the cap 42 beginning at a lower end 50 in the reservoir 44 and ending at an upper end or outlet 52 generally at the level of the wall 36.

The cap 42 has a bottom or end wall 54 and the side wall 48 defines a small air relief opening 56 at the level of the outlet 52. This opening is as small as is practical to permit very slow air flows.

The liquid in the dispenser 28 extends from an upper level 58 through the neck 32 and into the reservoir 44 ending at a level 60 which is at atmospheric pressure. The upper level 58 is maintained at a negative pressure by the head of liquid between the two levels 58 and 60 and the negative pressure is permanently trapped by the container until liquid is dispensed as will be described.

In the condition shown in FIG. 3, the liquid in the dispenser is equivalent to drawing designated A in FIG. 2. Unlike the structure described with reference to FIG. 1, however, temperature compensation and response are separated from one another due to the structure of the dispenser 28. Consider firstly an increase in temperature. This of course will be a slow event and as the temperature increases, the upper level 58 will drop and the lower level 60 will rise into the position shown at C which is equivalent to the position C of FIG. 1. In order for this to happen air will be displaced from the reservoir through the air relief opening 56 and some will be displaced from the passageway 46. Further increases in temperature will drive more of the liquid out of the dispenser following the graph line C-D. It should be noted, however, that this line will lie at a slightly different angle to the horizontal axis when compared with the line C-D of FIG. 1. In FIG. 1 the line will be at 45 degrees (provided the units on the axes are the same) whereas the line C-D of FIG. 2 will be at an angle slightly less than 45 degrees due to the displacement through the relief opening 56. The amount of liquid flow through this opening will be very small because in this embodiment it is designed to relieve air pressure rather than to provide liquid flow. However, in practice, the structure would be designed so that the anticipated temperature variations will be insufficient to drive the liquid as high as the hole 56.

Consider now the effect of squeezing the flexible container 30 shown in FIG. 3 in order to displace liquid through the passageway 46. Because the opening 56 is small, the sudden build-up in air pressure above level 60 in reservoir 44 can not expel a large volume of air through the opening 56, so that the pressure will be relieved by driving liquid through the passageway 46. There will therefore be a response time which is dependent primarily on the volume of the discharge passageway above the level 60 rather than on the volume of the reservoir 44. This contrasts with the embodiment shown in FIG. 1 because in this embodiment the reservoir must be cleared before flow takes place and this delays the response.

As seen in FIG. 2, the response will follow the horizontal axis of the graph to point B which corresponds to drawing B and then it will move along line B-E to the position corresponding to drawing E where it will be seen that the reservoir continues to contain air and that liquid is being dispensed all along this line. There will, of course, be a small flow of air through the air relief opening so that the line B-E will be parallel roughly to line C-D, but in any event less than 45 degrees to the horizontal axis.

Consider now some of the possible situations which may arise during use of the dispenser. The discharge shown at E will continue while the dispenser is squeezed and will cease once this force is removed. As soon as this force is removed, the walls of the container 30 will return to their original position causing a negative pressure within the container to draw liquid through the neck 32 and out of the reservoir 44. The negative pressure created in this way will of course suck air back through the passageway 46 and to a minor extent, through the relief opening 56. The majority of the air will pass through the passageway and because the neck 32 is drawing liquid back into the container 30, the air will tend to leave the passageway at the bottom end 50 and rise into the reservoir 44 so that it will tend to replace any liquid which has risen in the reservoir.

This is perhaps best illustrated by considering a situation such as that shown in drawing E of FIG. 2. Once the suction is created in the container, the negative pressure will cause air to move into the reservoir while liquid is drawn from the reservoir by the container reverting to its original shape. With proper selection of sizes in relation to viscosity and flow characteristics, the separation between the passageway 46 and the neck 32 will allow the air to leave the liquid and enter the reservoir rather than be trapped in the liquid and continue up through the liquid into the container 30. It is therefore important to ensure that there is separation if this possibility is to be avoided for a particular liquid and rate of flow, etc.

Different liquids will have different characteristics and these must be explored in finalizing the shape and proportions of the structure.

For instance, the neck could be designed to be positioned as far away from the passageway 46 as possible to give air drawn through the passageway time to leave the liquid and mix with the liquid in the reservoir as it rises to the top of the reservoir. Similarly, the passageway could be shaped to discharge away from the neck rather than towards it so that air would have to travel as far as possible through the liquid giving it time to move upwardly into the space above the liquid and also to cause mixing in the reservoir. This could be particularly useful for products such as orange juice which must be mixed to avoid the pulp clogging the outlet.

It should also be noted that the volume dispensed for a given pressure change in the container will depend on the size of the opening 56. This hole effectively bleeds off some of the energy provided to dispense. As the size of hole increases, so this loss increases. Consequently if the dispenser is to be varied to give different volumes of discharge for a given "squeeze" then this can be achieved simply by changing the size of opening 56 or of course by using a number of openings.

One further consideration in the response rate is the position of the bottom end of the outlet relative to the liquid in the reservoir. If in normal use, the bottom end is above the liquid, there will be no discharge until the liquid rises to the level of the outlet bottom end. Consequently point B in FIG. 2 will move towards point C. Also, because the initial flow from the container goes only into the reservoir, this flow will cause a sudden energetic mixing of the liquid in the reservoir. This mixing action can be useful when dispensing liquids containing solids.

Figure 4:
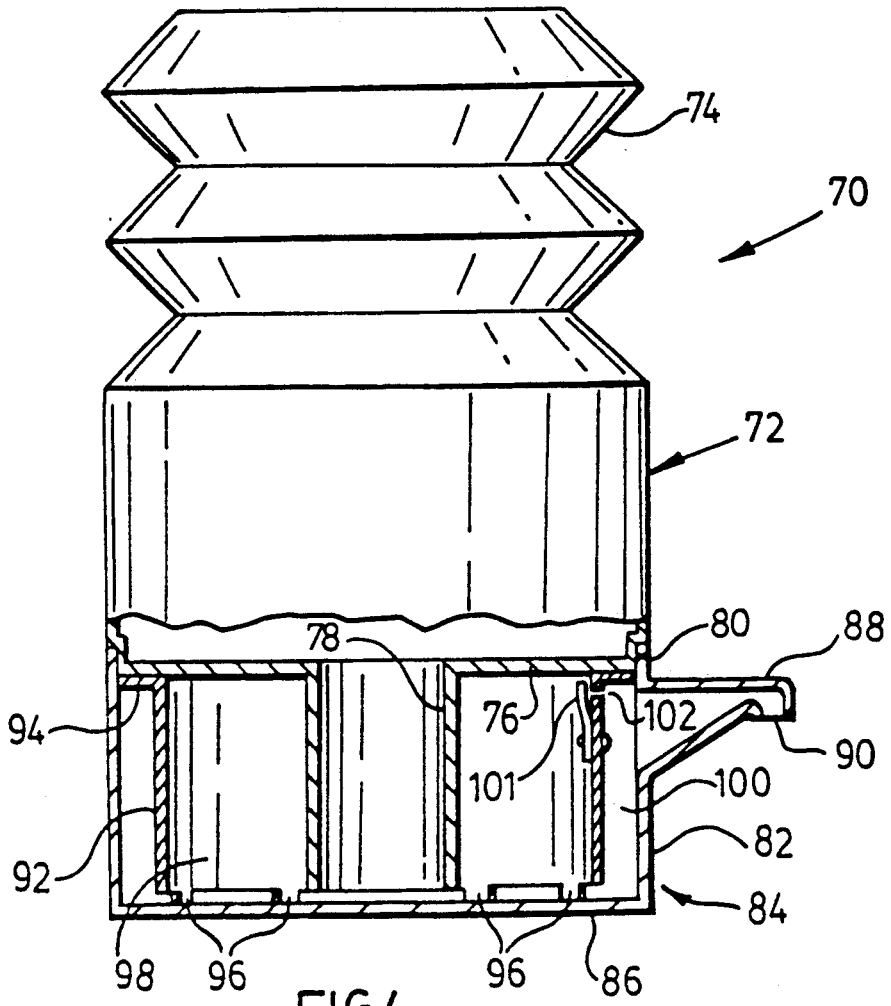
FIG. 4 is a view similar to FIG. 3 and illustrating a different embodiment cf the invention.

Reference is next made to FIG. 4 which illustrates another embodiment of the invention. In this case a dispenser designated generally by the numeral 70 includes a container 72 defining a compressible bellows 74 for displacing liquid from the dispenser at the upper end of the container, and at the lower end, a transverse wall 76 extends radially between a neck 78 and an annular recess 80 defined to receive the side wall 82 of a matching cap 84. This side wall extends from a base or bottom wall 86 and defines a dispensing head 88 terminating at a downwardly facing outlet 90.

Unlike the embodiment shown in FIG. 3, this embodiment includes an annular divider 92 having an upper outwardly extending radial flange 94 for location inside the cap and for engagement with the wall 76 to contain the divider between the wall 76 and the bottom wall 86 of the cap 84. The divider has a plurality of downwardly extending projections 96 in engagement with the wall 86 to provide flow clearance under the divider. In this drawing, no liquid is included in order to better illustrate the parts but it will be evident that a reservoir 98 is defined within the divider 92 by the neck 78 and wall 76 of the container 72. Outside the divider, and inside the cap side wall 82, there is an annular space 100 which combines with the dispensing head 88 to define a discharge passageway leading to the outlet 90.

Apart from the differences in the structure of the embodiment shown in FIG. 4, the embodiment operates in similar fashion of that illustrated in FIG. 3. However, in FIG. 4 there is an air relief opening 102 defined in the divider 92 adjacent the flange 94 and close to the dispensing head 88.

In operation, temperature compensation will be provided by the total volume of the reservoir 98 and the annular space 100. However, when the bellows 74 is compressed, there will be a response which is proportional to the volume of the annular space 100 and head 88 because air will be essentially trapped in the reservoir 98, relieved only to a minimal extent by the small opening 102. Liquid will flow from the neck 78 radially outwards and under the divider 92 into the annular space 100.

After the bellows has been operated and the force removed, the bellows will move to restore its original shape thereby sucking liquid back up the neck 78 and creating a negative pressure in the reservoir 98. Because liquid can enter the reservoir only under the divider, there will be a distribution around the annular space of air as it is sucked into the outlet 90 and then through the head 88 into the annular space 100. This will tend to ensure that liquid contained in the annular space, or discharge passageway, is drawn back into the reservoir ahead of any air so that liquid will be sucked into the container 72 essentially from the annular space 100. As soon as air passes under the divider 92, because of the large perimeter of this divider, the air will be moving relatively slowly and will have a tendency to rise upwardly into the reservoir while at the same time liquid from this reservoir continues to be drawn into the neck 78. There is therefore less tendency for air to find its way directly to the neck and hence to the top of the container instead of where it is preferred, i.e. in the reservoir. This structure can be used advantageously for more viscous materials.

The structure shown in FIG. 4 can be modified quite readily for different liquids by simply providing dividers of different proportions. Response time is proportional to the size of the annular space 100 and this can be varied by providing different dividers. Also, a simple flap valve 101 can be provided to seal the air relief opening 102 when the user activates the dispenser. The sudden pressure will seal the opening to prevent flow of air but the valve will be open on suck-back and also when there is flow caused by temperature variation.

It should also be noticed that in FIG. 4 the relief opening 102 is contained within the dispenser rather than exposed as is the case in FIG. 3. This also is preferable because during initial shipping of the package it is a simple matter to seal off the outlet 90 to retain the contents during shipment whereas a structure such as that shown in FIG. 3 would require closures over both the outlet 52 and the air relief opening 56 unless of course either the bottle is sealed or the container is guaranteed to be retained in a preferred orientation so that no discharge takes place. Because this is very unlikely it is preferred to use a structure such as that shown in FIG. 4 when a dispenser full of liquid is to be transported.

It should also be recognized that the FIG. 4 structure can have another advantage for some products. If the valve 101 is not used, there will be some mixing of air and product as the air passing through opening 102 meets product passing upwardly towards the outlet 90. This permits selection of proportions to cause a measure of product aeration which may be desirable in some products.

Figure 5:
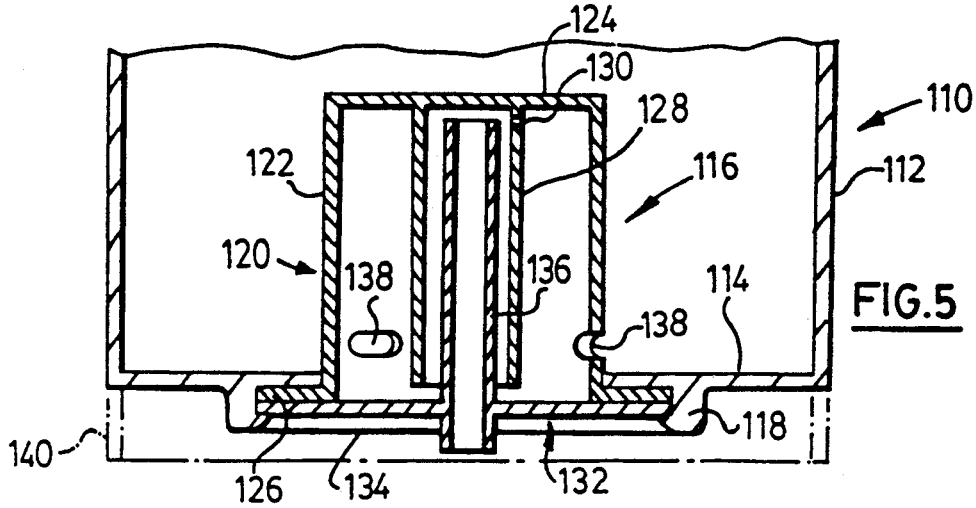
FIG. 5 is a sectional view of a portion of a dispenser showing a discharge assembly attached to the bottom wall of a container.

Reference is next made to FIG. 5 to illustrate a dispenser 110 (shown in part in this figure) which consists essentially of a container 112 which is filled through an opening in an end wall 114. After filling, a discharge assembly 116 is engaged in the opening in the end wall and held in place by an annular snap ring 118. The assembly consists of two parts. A first part 120 includes an annular wall 122 extending downwardly from a top wall 124 and terminating in an outwardly extending peripheral flange 126 proportioned to engage in the snap ring 118. The first part also includes a tubular portion 128 extending downwardly from the top wall 124 and defining adjacent this wall a small air relief opening 130.

A second part 132 of the discharge assembly 116 consists of a disk shaped wall 134 which is also proportioned to fit in the snap ring 118 in close engagement with the flange 126 of the first part, and a tube 136 extends inside the tubular portion 128 and defines an opening adjacent the air relief opening 130 and extends to a point outside the dispenser for discharging the liquid from the dispenser as will be described.

The two parts of the discharge assembly 116 combine to define a reservoir and discharge passageway. The reservoir is essentially between the tubular portion 128 and the wall 122 and liquid enters this reservoir through three openings 138 (two of which can be seen). The discharge passageway is defined by the inside of the tubular portion 128 and by the tube 136.

As temperature increases, the level will rise towards the opening 130 and air will be relieved through this opening to atmosphere via the tube 136. Liquid will of course also rise between the tube 136 and the tubular portion 128 and if the temperature continues to rise then liquid will eventually reach a level where it will enter the top of the tube 136 and discharge from the dispenser.

In normal use, when the dispenser is activated to force liquid through the openings 138, air will be effectively locked in the reservoir so that flow will take place upwardly between the tube 136 and the tubular portion 128 and then discharge through the tubular portion downwardly out of the dispenser. On suck-back, this tube will be cleaned and the equilibrium of the system will be reinstated.

This embodiment has the advantage that the container 112 can be manufactured quite simply, filled and then the discharge assembly 116 snapped in place. In order to obtain a proper seal it may be necessary to coat the flange 126 and wall 134 with a sealant or adhesive in order to ensure that the container is liquid-tight. A simple cap over the tube 136 where it projects outwardly from the dispenser is sufficient to close the assembly for shipment. In use it would be preferable to have the structure include a peripheral wall 140 (shown in ghost outline) so that the structure can stand on a flat surface ready for use.

It will also be appreciated that a similar structure could be made to attach to an existing container by adapting the discharge assembly to be attached by a screw fitting corresponding to the cap normally used on the container.

Figure 6:
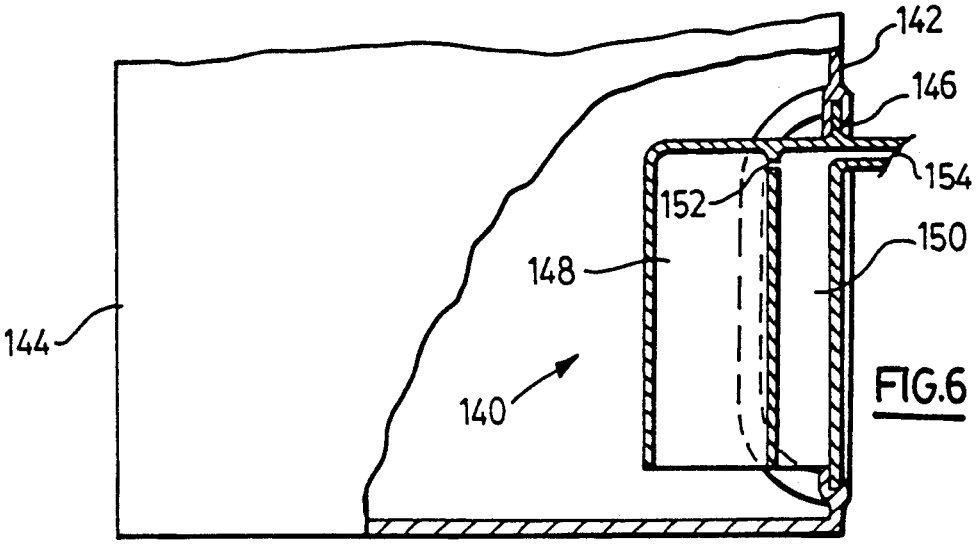
FIG. 6 is a view similar to FIG. 5 and showing a discharge assembly attached to the side wall of the container.

A further embodiment which has similar characteristics to that shown in FIG. 5 is shown in FIG. 6. In this figure a discharge assembly 140 is attached to a side wall 142 of a container 144 which could be filled through an opening containing the assembly 140 or through a conventional cap which is sealed to the container after it is filled.

The assembly has a peripheral flange 146 which is a snap fit in the wall 142 and defines a reservoir 148 and a discharge passageway 150.

The reservoir 148 and passageway 150 are connected by an air relief opening 152 so that during temperature increases both the reservoir and the passageway come into play to receive liquid and the pressure is equalized through the opening 152. When the dispenser is activated to discharge liquid, air will be trapped in the reservoir and the flow will be primarily through the outlet passageway 150 and through the outlet 154.

Although in this embodiment the air relief opening is internal between the reservoir and the outlet passageway, clearly by modifying the structure it would be possible to have this opening between the reservoir and the outside of the dispenser in a manner similar to that shown in FIG. 3. However the structure shown in FIG. 6 has the advantage that if the opening 154 is sealed, the structure can be transported without loss of contents and it is unnecessary to be concerned closing the air relief opening 152.

Figure 7:
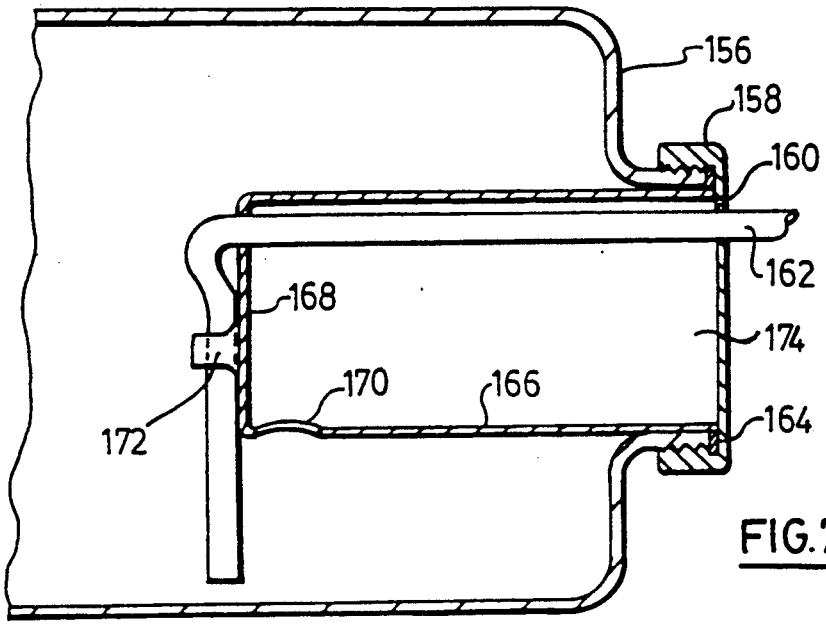
FIG. 7 is a still a further view similar to FIG. 5 showing a discharge assembly attached to the cap of a container.

Another embodiment is shown FIG. 7. A container 156 has a conventional screw cap 158 which has been modified to include an air relief opening 160 and to accommodate a tube 162. Under the cap 158 is trapped a peripheral flange 164 of a part of the assembly which includes a side wall 166 extending to an end wall 168 and defining an opening 170 to receive liquid from the container. The tube 162 extends through the wall 168 and is held in place by a clip 172 so that the inner end of the tube is adjacent the wall of the container 156. This container can be filled and then the cap and assembly engaged in the container ready for use.

When temperature rises, liquid will be moved through the opening 170 into a reservoir 174 formed by the walls 166, 168 and the cap 158. Air will be relieved through the opening 160. When it is desired to operate the dispenser, the walls are deflected and liquid will travel through the tube 162 and discharge out from the dispenser. There will of course, as is usual in all of these embodiments, be some minor flow into the reservoir as air pressure is relieved, but this will be minimal provided that the dispenser is activated in a normal fashion with a quick movement.

Once the container is relaxed, air will be sucked back through the tube.

This embodiment differs from others in some respects. First of all, the temperature compensation is quite separate from the discharge through the outlet passageway in the form of the tube 162 and also, because of the physical relationships, when the liquid level falls below the opening 170, then the temperature compensation will not involve liquid remaining in the container. From that point on the tube 162 acts like a dip-tube dispense.

Also, as is the case in other embodiments, if it is preferred to have the air relief opening internal rather than through an outside wall, it could be placed in the tube 162 within the structure so that the only exposed opening would be from the tube 162.

Figure 8:
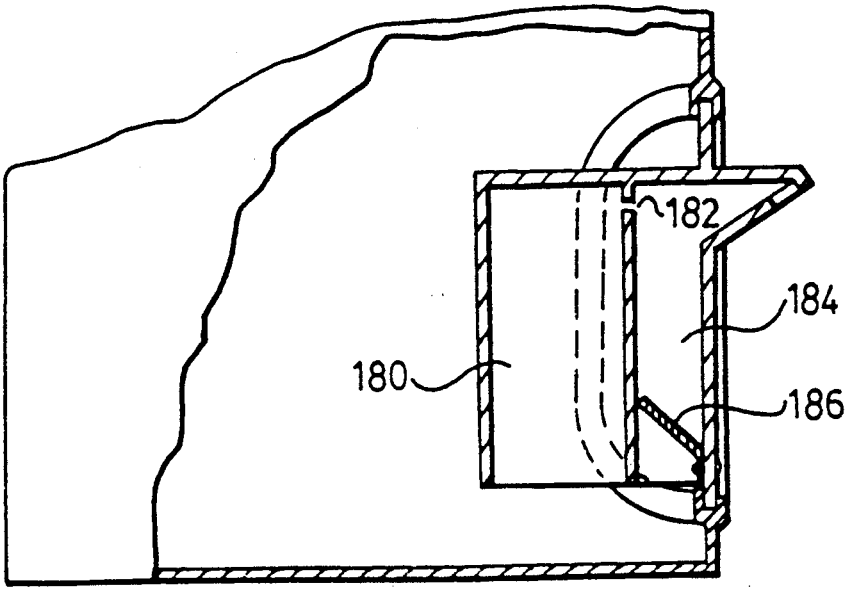
FIG. 8 (drawn adjacent FIG. 4) is a further view similar to FIG. 5 and showing another embodiment.

Reference is next made to FIG. 8 which illustrates an exemplary embodiment designed especially to handle liquids having a high-solids content. These liquids tend to allow air under quite small pressures to tunnel through the liquid rather than to push the liquid ahead of the air. Consequently fast suck-back will tend to leave liquid behind rather than clear it out. A solution to this problem is illustrated in FIG. 8. A reservoir 180 has an air relief opening 182 and a discharge passageway 184 contains a simple flexible flap valve 186 to allow liquid to flow out of the dispenser but which will prevent at least most of the suck-back. As a result, suck-back air passes slowly through opening 182 allowing time for the liquid to respond and return to the container because there is insufficient pressure drop between the top of the container and air in the reservoir for the air to tunnel through the liquid. The valve 186 can of course be arranged in many ways and could include an opening to ensure that some suck-back flow cleans the discharge passageway. However it may be preferable to minimize this flow in order to ensure that the valve 186 remains wet so that there is less likelihood of it sticking.

A similar result can be obtained in other embodiments. For instance if an equivalent to valve 186 were used in the passageway 46 of FIG. 3, on suck-back the air entering relief opening 56 would flow into the space above any liquid in the reservoir and apply atmospheric pressure to this liquid uniformly. This would avoid "tunnelling" and cause the liquid to flow evenly back through the neck and into the container until the pressures equalize.

The various air relief openings described in the embodiments have been shown as simple discrete holes. It should be noted that any form of structure which allows air flow would be acceptable as an equivalent. Such structures would include gaps in threaded parts, and grooves in mating parts. Also, the hole could be part of a fine tube which could for instance lead from opening 102 in FIG. 4 to the mouth 90 so that the air leaves externally but at the same time a single cap would close the dispenser.

Another variation which can have advantages relates to the size of the air relief opening. With the hole as small as possible, during use very little air will leave so that the reservoir receives some liquid but not a significant amount. If for any reason the discharge from a particular dispenser is too great, the opening can be enlarged to permit some of the liquid discharged from the container to enter the reservoir as air leaves through the air relief opening. The resulting storage of liquid in the reservoir will reduce the discharge and will be rushed back into the container after the dispenser has been used.

A further consideration which permits great variation lies in the method of applying pressure to the liquid to cause dispensing. This can be done in any suitable fashion including using a rigid container and a separate pressure source.

It will now be appreciated that many different embodiments can be designed within the scope of the invention and for a great variety of liquids. One example of an advantageous use of the invention is to be found in dispensing orange juice containing some pulp. If such juice is poured from a bottle when needed, the bottle must be shaken to avoid all of the pulp being dispensed with the last serving of the juice. The present invention can provide dispensers to avoid this. Consider a structure such as that shown in FIG. 3. Pulp will tend to collect in the reservoirs. When the dispenser is actuated, the juice will tend to flow from the neck of the container as directly as possible to the outlet and will push some pulp ahead leaving a tunnel through which the remainder of the serving of juice will pass. After dispensing, the inward rush of air during suck-back through the outlet will bubble through the juice and pulp, and in the confused flow, the pulp will be mixed in the juice before another serving. There will consequently be some pulp in every serving without the need to shake the dispenser. This and other such structures and uses are within the scope of the claims. As mentioned, the forms of structures will be dictated by the liquids to be dispensed and by the different environments in which the dispensers are used. All of these embodiments are within the scope of the claimed invention.

I claim:

1. A dispenser for liquids, the dispenser comprising:

container means having an outlet and extending upwardly from the outlet, the outlet being at a predetermined first level and the container means being deformable for varying the pressure in the container;

a reservoir having a bottom wall and coupled to the container above the outlet and containing the outlet near the bottom wall for receiving liquid from the outlet;

a discharge passageway coupled to the reservoir and extending upwardly from within the reservoir and terminating at a discharge opening at a second level above said first level; and an air relief opening in the reservoir providing communication between atmosphere and the inside of the reservoir, the opening being above said first level and no lower than said second level whereby deforming the container means causes liquid to be displaced from the container means into the reservoir and then through the passageway while air is trapped in the reservoir above said first level, and whereby during storage of the dispenser, gradual temperature increases will cause the level of liquid in the reservoir to rise as air is displaced slowly through the air relief opening.

2. A dispenser for liquids comprising:

a container for holding liquid at levels above a predetermined level and including pressure varying means to vary the pressure in the container;

a reservoir coupled to the container to form an assembly and in fluid communication with the container, the reservoir defining an air relief opening to permit pressure changes caused by temperature fluctuations to be equalized with atmospheric pressure; and a discharge passageway structurally connected to said assembly and including an outlet, the passageway being in fluid communication with the container to lead liquid to the outlet when said pressure varying means is used to increase the pressure in the container.

3. A dispenser for liquids comprising;

a container for holding liquids at levels above a predetermined level and including pressure varying means to vary the pressure in the container; and a discharge assembly attached to the container, the discharge assembly including an outlet at a level below said predetermined level, a reservoir coupled to the container and in fluid communication with the container and defining an air relief opening to maintain atmospheric pressure in the reservoir regardless of pressure changes in the container caused by temperature fluctuations, and a discharge passageway in fluid communication with the container to lead liquid from the container to the outlet when said pressure varying means is used to increase the pressure in the container.

4. In a dispenser of the type having a flexible container including an outlet for holding a liquid, above the outlet and means containing the liquid in the container such that there is a negative pressure in the container above the liquid, the improvement wherein said means comprises:

a temperature compensating reservoir extending upwardly above said outlet and coupled to the container, the reservoir being in liquid communication with the container and having air relief means to equalise the pressure in the reservoir with atmosphere during changes in ambient temperature; and a discharge passageway coupled to the reservoir and in liquid communication with the reservoir for carrying liquid being dispensed in response to deforming the container.

5. A dispenser for liquids, the dispenser comprising:

a container for liquid, the container being closed above the liquid to develop a negative pressure due to the force of gravity on the liquid so that the liquid level is normally above a predetermined level;

a reservoir coupled to the container and having a bottom access below the predetermined level for liquid from the container and extending upwardly, the reservoir defining a pressure relief opening;

an outlet passageway coupled to the container and in communication with the reservoir and terminating at an outlet positioned so that there is no flow through the outlet when the dispenser is not actuated, the reservoir providing space for liquid to accumulate to compensate for temperature changes in the container and the relief opening permitting equalization with atmospheric pressure during temperature compensation; and the outlet and relief opening being proportioned so that on actuating the dispenser by changing said negative pressure to a more positive pressure, liquid will flow through the outlet with minimal air flow through the relief opening.

6. A dispenser as claimed in claim 5 in which the container is an inverted bottle.

7. A dispenser as claimed in claim 5 in which the reservoir and outlet passageway define a discharge assembly and in which the container and discharge assembly define means for attaching the discharge assembly to the container.

8. A dispenser as claimed in claim 6 in which the reservoir surrounds the neck of the bottle so that flow from the container to the reservoir is radial.

9. A dispenser as claimed in claim 8 in which the outlet passageway includes a portion surrounding the reservoir so that flow from the reservoir to the outlet passageway is radial.

10. A dispenser as claimed in claim 5 in which the reservoir is defined by a cap attached to the container.

11. A dispenser as claimed in claim 5 in which the container is resilient to permit squeezing to actuate the dispenser.

12. A dispenser as claimed in claim 5 in which the container includes a resilient bellows to permit actuating the dispenser by deflecting the bellows.

13. A dispenser as claimed in claim 5 and further comprising a one way valve associated with the relief opening to permit flow through the opening during temperature compensation and to permit flow into the reservoir after actuation but to limit flow of air out of the reservoir during actuation of the dispenser.

14. A dispenser as claimed in claim 5 and further comprising a one way valve positioned to control flow through the outlet passageway such that flow takes place during actuation but is limited by the one way valve after actuation so that air drawn into the dispenser passes through the relief opening and into the reservoir.

15. A dispenser as claimed in claim 5 in which the relief opening communicates directly with atmosphere on the outside of the dispenser.

16. A dispenser as claimed in claim 5 in which the relief opening communicates with atmosphere in the outlet passageway.

17. A dispenser as claimed in claim 5 in which the outlet is at the bottom of the dispenser.

18. A dispenser as claimed in claim 5 in which the outlet is in the side of the dispenser.

19. A dispenser for liquids comprising:

a resilient and deformable container for holding liquid at levels above a predetermined level;

an outlet at a level below said predetermined level;

a reservoir coupled to the container to form an assembly, the reservoir being in fluid communication with the container to receive liquid through said outlet and the reservoir having an air relief opening to permit pressure changes caused by temperature fluctuations to be equalized with atmospheric pressure; and a discharge passageway structurally connected to said assembly, the passageway being in fluid communication with the container to discharge liquid from the dispenser in response to deformation of the container.

20. A dispenser as claimed in claim 19 in which the dispenser is an inverted bottle.

21. A dispenser as claimed in claim 20 in which the reservoir surrounds the neck of the bottle so that flow from the container to the reservoir is radial.

22. A dispenser as claimed in claim 21 in which the outlet passageway includes a portion surrounding the reservoir so that flow from the reservoir to the outlet passageway is radial.

23. A dispenser as claimed in claim 20 in which the reservoir is defined by a cap attached to the container.

24. A dispenser as claimed in claim 20 in which the container includes a resilient bellows to permit actuating the dispenser by deflecting the bellows.

25. A dispenser as claimed in claim 20 and further comprising a one way valve associated with the relief opening to permit flow through the opening during temperature compensation and to permit flow into the reservoir after actuation but to limit flow of air out of the reservoir during actuation of the dispenser.

26. A dispenser as claimed in claim 20 and further comprising a one way valve positioned to control flow through the outlet passageway such that flow takes place during actuation but is limited by the one way valve after actuation so that air drawn into the dispenser passes through the relief opening and into the reservoir.

27. A dispenser as claimed in claim 20 in which the relief opening communicates directly with atmosphere on the outside of the dispenser.

28. A dispenser as claimed in claim 20 in which the relief opening communicates with atmosphere in the outlet passageway.

29. A dispenser for liquids comprising:

a container for holding liquid at levels above a predetermined level;

pressure varying means coupled to the container for use to vary the pressure in the container;

an outlet on the container at a level below said predetermined level;

a reservoir attached to the container to form an assembly, the reservoir being attached to the container about the outlet to receive liquid from the container and the reservoir having an air relief opening to permit pressure changes caused by temperature fluctuations to be equalized with atmospheric pressure; and a discharge passageway attached to the assembly to discharge liquid from the dispenser in response to pressure increased in the container caused by said pressure varying means.

30. A dispenser as claimed in claim 29 in which the dispenser is an inverted bottle.

31. A dispenser as claimed in claim 30 in which the reservoir surrounds the neck of the bottle so that flow from the container to the reservoir is radial.

32. A dispenser as claimed in claim 31 in which the outlet passageway includes a portion surrounding the reservoir so that flow from the reservoir to the outlet passageway is radial.

33. A dispenser as claimed in claim 30 in which the reservoir is defined by a cap attached to the container.

34. A dispenser as claimed in claim 30 in which the container includes a resilient bellows to permit actuating the dispenser by deflecting the bellows.

35. A dispenser as claimed in claim 30 and further comprising a one way valve associated with the relief opening to permit flow through the opening during temperature compensation and to permit flow into the reservoir after actuation but to limit flow of air out of the reservoir during actuation of the dispenser.

36. A dispenser as claimed in claim 30 and further comprising a one way valve positioned to control flow through the outlet passageway such that flow takes place during actuation but is limited by the one way valve after actuation so that air drawn into the dispenser passes through the relief opening and into the reservoir.

37. A dispenser as claimed in claim 30 in which the relief opening communicates directly with atmosphere on the outside of the dispenser.

38. A dispenser as claimed in claim 30 in which the relief opening communicates with atmosphere in the outlet passageway.

* * * * *